US006385785B1

(12) United States Patent
Linden

(10) Patent No.: US 6,385,785 B1
(45) Date of Patent: May 14, 2002

(54) URINE SHIELD REMOVABLY ATTACHED TO TOILET SEAT

(76) Inventor: Carol S. Linden, 940 Fairview Ave., Brentwood, CA (US) 94513

( * ) Notice: Subject to any disclaimer, the term of this patent is extended or adjusted under 35 U.S.C. 154(b) by 0 days.

(21) Appl. No.: 09/795,338

(22) Filed: Feb. 27, 2001

(51) Int. Cl.[7] ..... E03D 9/00; F15D 1/00

(52) U.S. Cl. ..... 4/300.3; 4/DIG. 5; 4/661; D23/310

(58) Field of Search ..... 4/DIG. 5, 300.3, 4/661; D23/310

(56) References Cited

U.S. PATENT DOCUMENTS

| | | | | |
|---|---|---|---|---|
| 2,489,967 | A | * 11/1949 | Lavine | |
| 2,703,407 | A | * 3/1955 | Henoch et al. | |
| 2,839,764 | A | * 6/1958 | Gardner | |
| 2,980,919 | A | 4/1961 | Otto et al. | |
| 3,071,778 | A | 1/1963 | Renshaw | |
| 4,044,405 | A | * 8/1977 | Kreiss | |
| 4,348,776 | A | 9/1982 | Sarjeant | 4/300.3 |
| 4,744,113 | A | 5/1988 | Kogut | 4/661 |
| 4,813,087 | A | * 3/1989 | Sperka et al. | |
| 5,077,840 | A | 1/1992 | Masters et al. | 4/300.3 |
| 5,117,512 | A | 6/1992 | Bressler | 4/300.3 |
| 5,276,925 | A | 1/1994 | Blaha | 4/300.3 |
| 5,373,589 | A | 12/1994 | Rego et al. | 4/300.3 |
| 5,465,431 | A | 11/1995 | Wertz | 4/300.3 |
| D365,386 | S | 12/1995 | McDonald et al. | D23/309 |
| D369,856 | S | * 5/1996 | Lucido et al. | |
| 5,564,135 | A | 10/1996 | Jones et al. | 4/300.3 |
| D394,497 | S | 5/1998 | Johnson | D23/310 |
| D394,900 | S | 6/1998 | Kang | D23/307 |
| D405,168 | S | 2/1999 | Henry | D23/30 |
| 5,983,410 | A | * 11/1999 | Webster | |
| 6,178,567 | B1 | * 1/2001 | Bliss | |

FOREIGN PATENT DOCUMENTS

| | | | |
|---|---|---|---|
| JP | 2261137 | * 10/1990 | 4/300.3 |

* cited by examiner

*Primary Examiner*—Timothy L. Maust
*Assistant Examiner*—Khoa D. Huynh
(74) *Attorney, Agent, or Firm*—Sharon J. Adams

(57) ABSTRACT

A rectangular flexible shield that is placed into the toilet bowl shielding the back and sides of the bowl to prevent or reduce urine spills. The urine shield is removably attached to the raised toilet bowl seat by a generally u-shaped hook.

3 Claims, 4 Drawing Sheets

URINE SHIELD REMOVABLY ATTACHED TO TOILET SEAT

CROSS REFERENCE TO RELATED APPLICATIONS

Not Applicable.

FEDERAL SPONSORSHIP

Not Applicable.

FIELD OF INVENTION

This invention relates to a guard or shied removably attached to a toilet seat and used to direct the urine stream of a young boy into the toilet bowl, and to prevent splashing and missing of the toilet bowl.

BACKGROUND OF THE INVENTION

A variety of apparatuses for preventing urine spills have been proposed. There are a whole series of patents describing devices that open when the toilet seat is raised and close when the toilet seat is lowered. Some recent examples of such devices are seen in U.S. Pat. No. 5,564,135, issued to Jones on Oct. 15, 1996; U.S. Pat. No. 5,373,589, issued to Rego and Levesque on Dec. 20, 1994; U.S. Pat. No. 5,276,925, issued to Blaha on Jan. 11, 1994; and U.S. Pat. No. 4,348,776, issued to Sarjeant on Jul. 27, 1981. All of the above-described devices are permanently or semi-permanently attached to the toilet bowl making cleaning of the devices difficult. In contrast, the present invention is designed to be easily removed from the toilet bowl to facilitate use of and cleaning of the device.

There is another series of patents that describe urine shields that are mounted on the toilet bowl rim by means of a flange or similar part. The use of a flange, clips, or other means of mounting the shield on the toilet bowl rim makes placement and removal of the shield difficult. In all of these patents, the urine shield must be carefully positioned to fit exactly on the toilet bowl rim. For example, U.S. Pat. No. 3,071,778 issued to Renshaw on Jan. 8, 1963, discloses a toilet shield that is mounted by means of a "C" shaped flange on either the toilet bowl rim or the toilet seat. In a comparable design, U.S. Pat. No. 2,980,919 issued to Otto and Swann on Apr. 25, 1961, discloses a toilet shield that attaches to the toilet rim by means of an outwardly projecting flange. In another comparable design, U.S. Pat. No. 5,077,840, issued to Masters et al. on Jan. 7, 1992, claims a toilet shield that is held in place by a means for supporting the shield on the toilet bowl rim. The support means is described in the specification as a "flange or like part." In yet another comparable design, U.S. Pat. No. 5,465,431, issued to Wertz on Nov. 14, 1995, discloses a lip that mounts on the toilet bowl rim.

There are also design patents that describe toilet shields that are mounted on the toilet bowl rim by means of a flange or similar device. These include U.S. Pat. No. D394,900, issued to Tae Cho Kang on Jun. 2, 1998; U.S. Pat. No. D405,168, issued to Henry on Feb. 2, 1999; and U.S. Pat. No. D365,386, issued to McDonald et al. on Dec. 12, 1995.

In a related series of patents, the shield is mounted on the toilet bowl rim by means of hooks, clips, or other similar device. For example, U.S. Pat. No. 5,117,512, issued to Bressler on Jun. 2, 1992, discloses a shield or guard that is secured on the toilet bowl rim by means of clips. U.S. Pat. No. D394,497, issued to Johnson on May 19, 1998, claims a design for a shield that is mounted on the toilet bowl rim by means of clips with screws. U.S. Pat. No. D369,856, issued to Lucido on May 14, 1996, claims a design that is mounted to the toilet bowl rim by means of suction cups and clip-like projections.

The use of a flange, clips, or other means of mounting the shield on the toilet bowl rim makes placement and removal of the shield unwieldy. In order to remove the shield it will have to be disengaged from the entire toilet bowl rim. Removal of such a shield will require the use of two hands to manipulate the shield. Likewise, inserting a shield that is mounted on the toilet bowl rim will require exact alignment of the shield and rim. This is especially true for Otto et al., U.S. Pat. No. 2,980,919, and Lucido, U.S. Pat. No. D369,856, which both have members that fit underneath the toilet bowl rim. Moreover, because toilet bowls come in different sizes, the use of flanges or clips with an inflexible shield will mean that the shield can only fit on one toilet bowl size.

The present invention is attached to the toilet simply by mounting the shield on the raised toilet seat. The present invention can be easily removed by lifting the shield upwards. The present invention can be removed using only one hand. The present invention can be easily inserted into the toilet bowl by compressing the sides of the shield and placing the hook on the toilet seat.

The present invention is made out of a flexible material so that it will fit into any size toilet bowl. Several of the toilet guard patents describe guards made out of solid material that will fit on only one size toilet bowl. Masters et al. (U.S. Pat. No. 5,077,840) discloses a free standing, non-resilient channel to direct urine into the toilet bowl. Likewise, Renshaw (U.S. Pat. No. 3,071,778) discloses a funnel shaped guard that necessarily made of a solid material. In a comparable design, Wertz, (U.S. Pat. No. 5,465,431) discloses a urinal trainer made out of rigid plastic material. The use of solid material for the shield means that the shield will fit only one size toilet bowl, or that different shields must be purchased for different size bowls. The present invention is made out of flexible material and can be used in any size bowl.

The prior art also includes targets for improving a boy's aim while urinating. U.S. Pat. No. 4,744,113, issued to Kogut on May 17, 1988, discloses a target that is attached to the toilet bowl rim and shows a picture only after getting wet. In a comparable design, U.S. Pat. No. 4,044,405, issued to Kreiss on Aug. 30, 1977, discloses a target that may be placed inside the toilet bowl. Neither of these inventions includes a urine shield. Bressler, U.S. Pat. No. 5,117,512, discloses a target on the urine shield. However, the target is placed above the rim of the toilet bowl. This will have the effect of teaching boys to direct the urine stream too high. One embodiment of the present invention discloses a target placed close to the water surface, teaching boys to direct the urine stream into the toilet bowl.

BRIEF SUMMARY OF THE INVENTION

The present invention is a flexible shield that is used to toilet train boys. The shield is inserted into the toilet bowl along the back rim of the bowl. A clip on the back of the shield attaches to the upraised toilet bowl seat and allows the shield to be easily inserted and easily removed. The shield prevents urine from splashing outside the toilet bowl. The shield also may contain a target to encourage proper aiming of the urine stream.

OBJECTS AND ADVANTAGES

Several of the objects and advantages of the present invention are described below.

One object of the invention is to direct the urine stream of a boy into the toilet bowl, so as to avoid messy spills and clean-up.

It is a further object to provide an easy to insert and easy to remove urine shield that fits on any size toilet bowl.

It is still a further object to provide an inexpensive urine shield.

It is still a further object to provide an easy to clean urine shield.

It is still a further object to help to teach boys to direct their urine stream into the toilet bowl.

Further objects and advantages will become apparent from a consideration of the ensuing description and drawings.

DETAILED DESCRIPTION OF THE INVENTION

Figure 1:
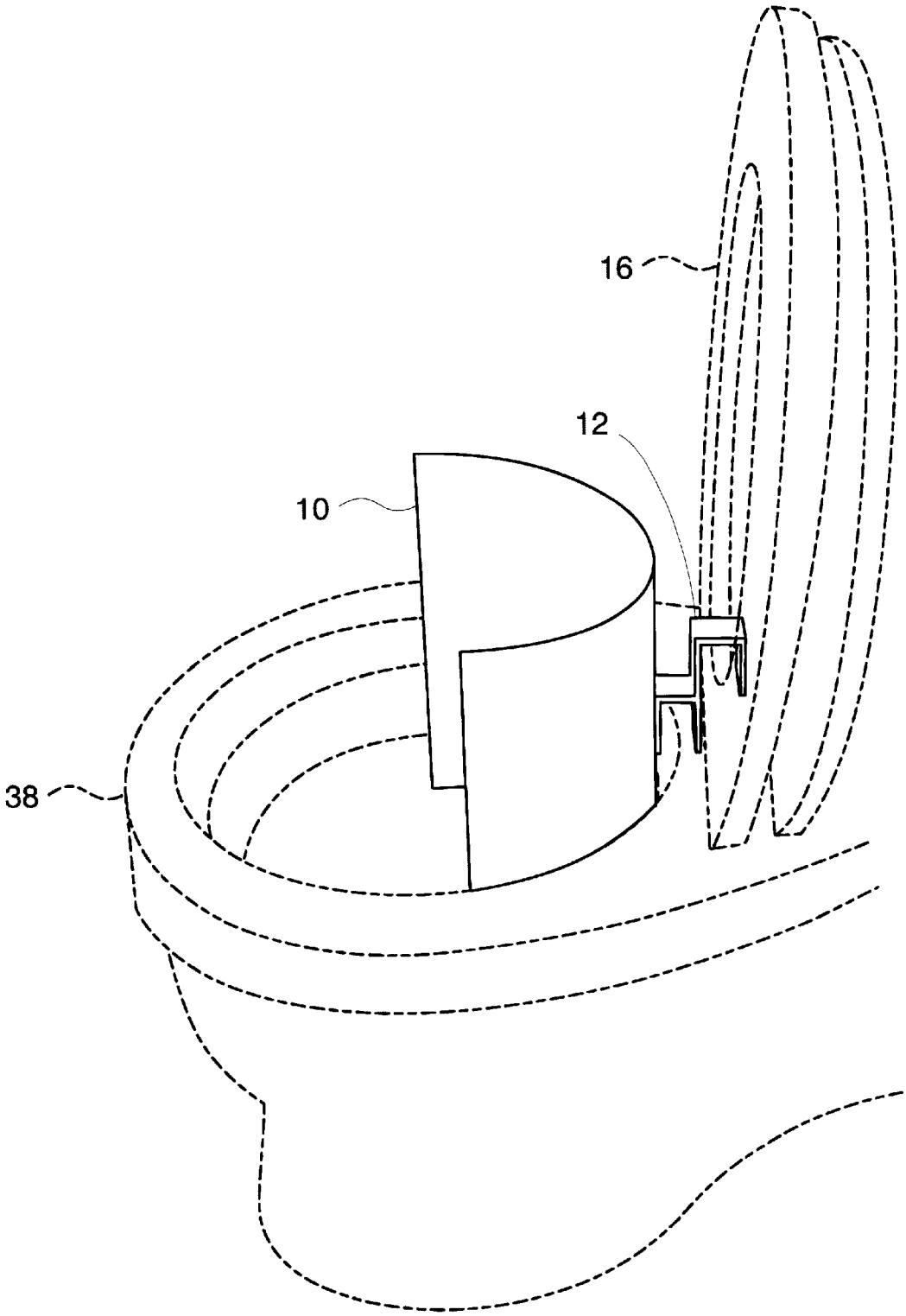
FIG. 1 is a perspective view from the side of the urine shield attached to the upraised seat of the toilet bowl.

Referring to the drawings, FIG. 1 shows the urine shield 10 with attachment member 12 holding the shield in place on the upraised toilet bowl seat 16. Urine shield 10 is preferably made out of flexible plastic, but may be made out of any flexible material such as flexible vinyl, high-density polymer, rubber, leather, or other flexible material.

When the flexible urine shield 10 is in place it hang down inside the toilet bowl rim. It will curve along the inside of the toilet bowl rim and will cover the back and sides of the toilet bowl.

Figure 3:
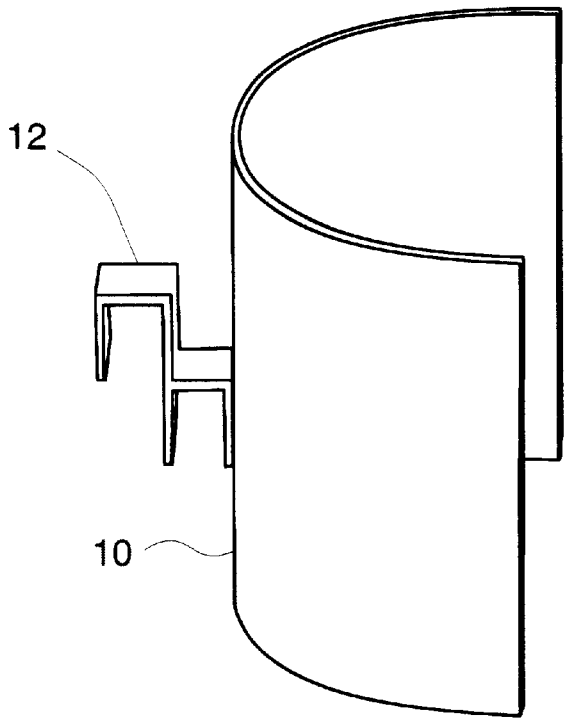
FIG. 3 is a side view of the urine shield showing one embodiment of the attachment member.

FIG. 3 shows a side view of one embodiment of attachment member 12. In this embodiment attachment member 12 is a generally u-shaped clip, and is preferably made as a single piece of molded, hard plastic, but may be made out of any rigid material that will support the weight of urine shield 10. Likewise, it is not required that attachment member 12 be made as a single unit. Attachment member 12 may be made out of several separate sections that are subsequently permanently attached to form attachment member 12.

Attachment member 12 adheres to urine shield 10 by any means that will permanently affix attachment face 20 to urine shield 10. The inventor currently prefers using glue, but attachment face 20 may be permanently affixed to urine shield 10 using any number of permanent attachment means, including but not limited to, screws, bolts, cement, adhesives, or thermal bonding.

Figure 4:
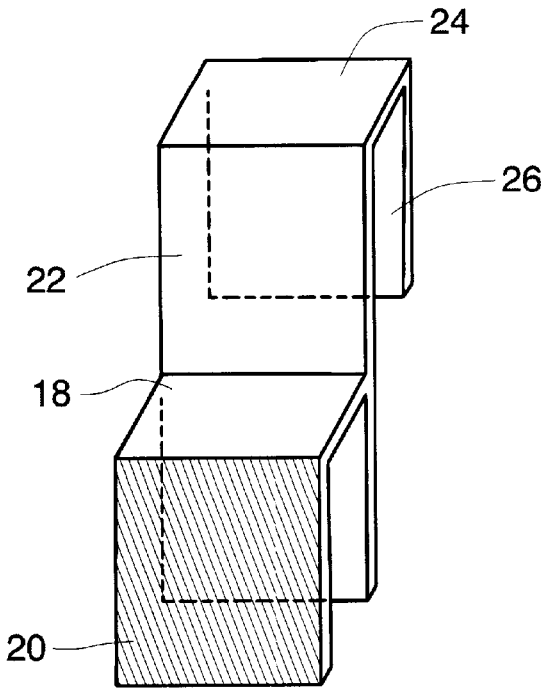
FIG. 4 is a perspective view of attachment member 12.

As shown in FIG. 4, attachment member 12 has a spacer 18. Spacer 18 creates a sufficient distance between urine shield 10 and upraised toilet bowl seat 16 such that the urine shield 10 can be easily slipped into the toilet bowl. The inventor currently prefers making spacer 18 five-eighths inches long. However, it is apparent that spacer 18 can be of any length, including zero, needed to permit easy insertion and removal of urine shield 10.

Spacer 18 is positioned approximately in the middle of front support face 22. Front support face 22 may be any length needed to adequately support and hold urine shield 10 in place. The inventor currently prefers making front support face 22 three inches long. Front support face 22 is connected with seat spacer 24. Seat spacer 24 may be any length needed to allow front support face 22 to be on the front of upraised toilet bowl seat 16 and rear support face 26 to be on the rear of upraised toilet bowl seat 16. Seat spacer 24 may be made in different lengths to co-ordinate with toilet bowl seats of different thickness. The inventor currently prefers making seat spacer 24 five-eighths inches long, because this fits over a standard thickness toilet bowl seat.

Figure 5:
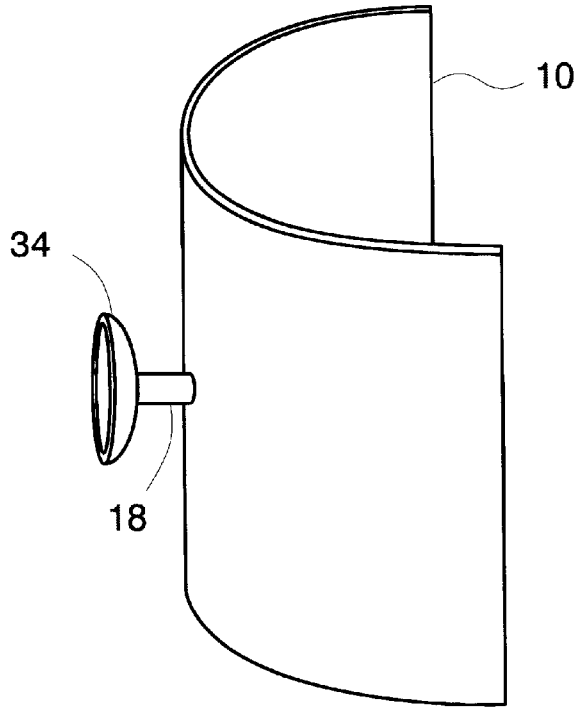
FIG. 5 is a perspective view of an alternative embodiment of attachment members 12.

FIG. 5 shows an alternative embodiment of attachment member 12. This embodiment uses a suction cup 34 instead of a generally u-shaped clip. Most toilet bowl seats come in a standard thickness, over which seat spacer 24 will easily fit. However, some toilet bowl seats have different widths. Suction cup 34 allows urine shield 10 to be removably attached to any and all sizes of upraised toilet bowl seats 16. Suction cup 34 may either be attached directly to urine shield 10, or may be attached to urine shield 10 by means of a spacer 18 and front support face 22, as is described above. As a third alternative, suction cup 34 may be attached to spacer 18, and spacer 18 may be attached directly to urine shield 10.

Figure 2:
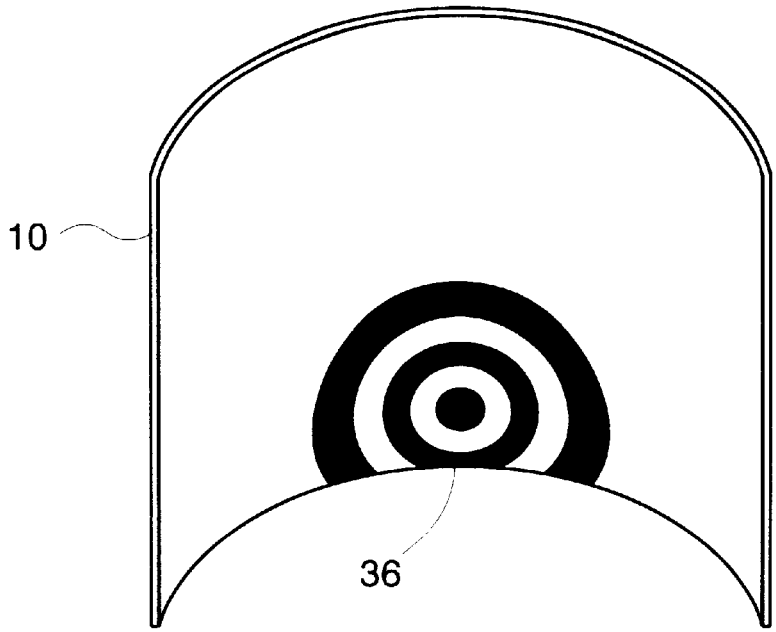
FIG. 2 is a front view of the urine shield showing the shield with a target, and also showing scoring so that the shield may be cut to a different length.

The invention has two embodiments with targets. The first embodiment is shown in FIG. 2 as a "bull's-eye" design 36 printed directly on urine shield 10. The bull's-eye design 36 is simply one example of a design placed on urine shield 10 and is not meant to limit the type of design that may be used. Any design may be used. The design is placed along the lower edge of urine shield 10 to encourage boys to aim into the toilet bowl.

Figure 6:
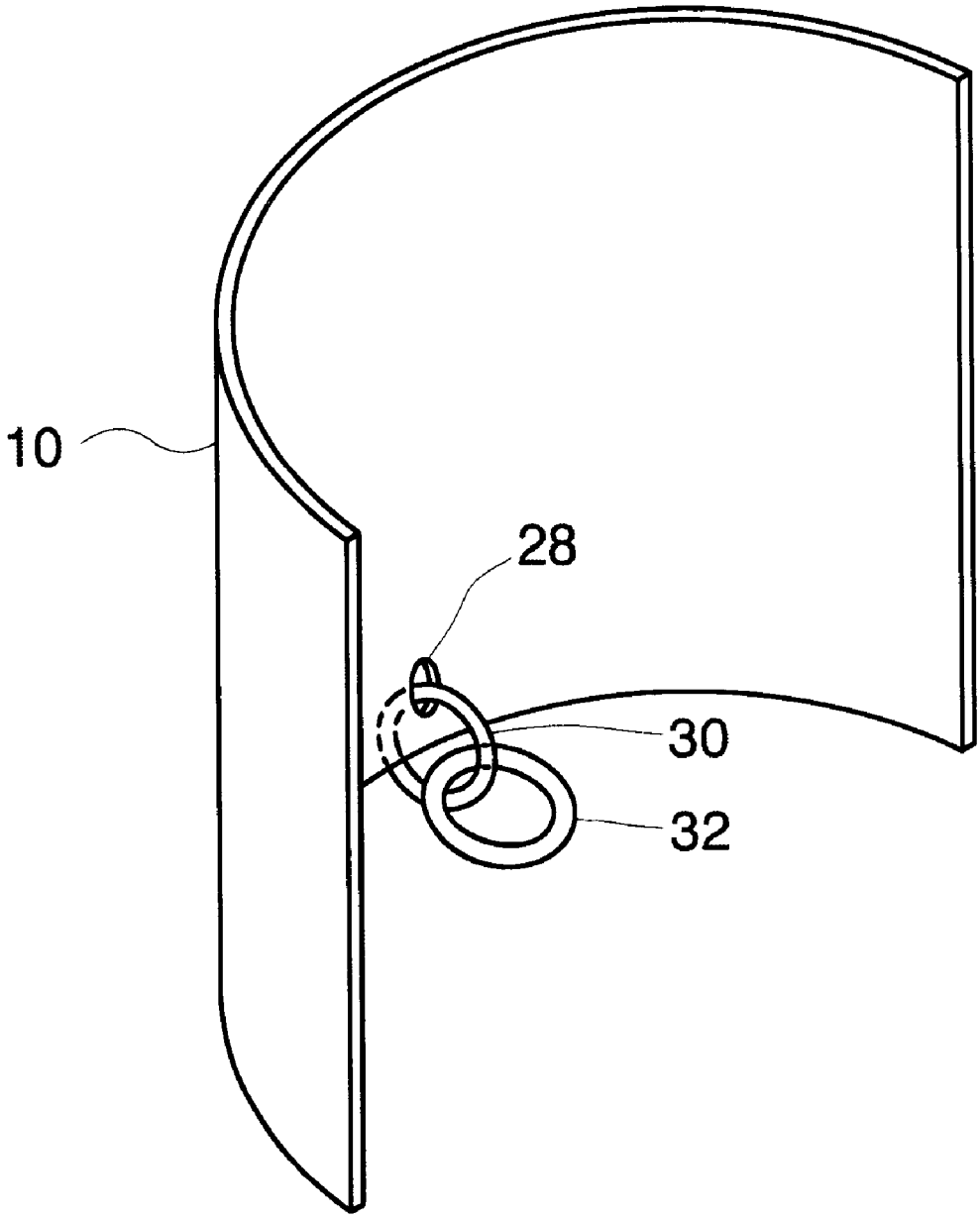
FIG. 6 is a front view of the urine shield showing one embodiment of the target.

Another target embodiment is shown in FIG. 6. Hole 28 is centered near the lower edge, and in the middle, of urine shield 10. Securing device 30 fits into hole 28 and thereby attaches movable target 32 to urine shield 10. Moveable target 32 may be any shape that may be attached to securing device 30. Securing device 30 allows moveable target 32 to float in or below the water level, thereby encouraging boys to direct their urine stream into the toilet bowl water.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A urinal shield in combination with a conventional toilet bowl, said toilet bowl having a curved interior rim with a back and sides, and a toilet seat that can be raised and lowered, the improvement comprising (a) a flexible shield that curves along the back and sides of the curved interior rim, said flexible shield having a vertical plane, a horizontal plane, a top edge, a bottom edge, and two side edges, said vertical plane of the shield extending from below the curved interior rim of the toilet bowl to above the curved interior rim of the toilet bowl, and said horizontal plane of the flexible shield extending along the back and sides of the curved interior rim of the toilet bowl;

wherein the flexible shield has a hole near the bottom edge of the flexible shield, and wherein a securing device is inserted into the hole, and wherein a moveable target is attached to the securing device that is inserted into the hole near the bottom edge of the flexible shield; and (b) an attachment member permanently affixed to the flexible shield and removably attachable to the raised toilet seat so that the flexible shield can be easily removed every time the toilet seat is lowered.

2. A toilet accessory according to claim 1, wherein the attachment member used for removably attaching the flexible shield to the raised toilet seat is a generally u-shaped clip attached to the flexible shield by a spacer and an attachment face wherein said spacer, generally u-shaped clip, attachment face, and flexible shield remain in a fixed relationship to each other.

3. A toilet accessory according to claim 1, wherein the flexible shield has a target design placed so that the target design will be below the curved interior rim of the toilet bowl.

* * * * *